US007832713B2

(12) United States Patent
King

(10) Patent No.: US 7,832,713 B2
(45) Date of Patent: Nov. 16, 2010

(54) GUARD RAIL MOUNTING BLOCK AND GUARD RAIL SYSTEM INCORPORATING THE SAME

(75) Inventor: David T. King, Elizabethtown, KY (US)

(73) Assignee: K.E.S.S. Inc., Elizabethtown, KY (US)

( * ) Notice: Subject to any disclaimer, the term of this patent is extended or adjusted under 35 U.S.C. 154(b) by 0 days.

(21) Appl. No.: 12/070,056

(22) Filed: Feb. 14, 2008

(65) Prior Publication Data

US 2008/0265231 A1 Oct. 30, 2008

Related U.S. Application Data

(63) Continuation-in-part of application No. 11/980,971, filed on Oct. 31, 2007, now Pat. No. 7,559,535, which is a continuation of application No. 11/821,954, filed on Jun. 26, 2007, which is a continuation of application No. 11/081,821, filed on Mar. 16, 2005, now Pat. No. 7,234,687, which is a continuation-in-part of application No. 10/885,398, filed on Jul. 6, 2004, now abandoned.

(60) Provisional application No. 60/901,378, filed on Feb. 14, 2007.

(51) Int. Cl.
*E01F 15/00* (2006.01)

(52) U.S. Cl. ..... 256/13.1; 404/6

(58) Field of Classification Search ..... 256/13.1, 256/65.02, 65.03; 404/6
See application file for complete search history.

(56) References Cited

U.S. PATENT DOCUMENTS 2,701,127 A 2/1935 Elliot
2,056,842 A 10/1936 Edgecomb
2,603,455 A 7/1952 Welch
3,317,189 A 5/1967 Rubenstein
3,360,244 A 12/1967 Bucher
3,493,213 A 2/1970 Ackerman (Continued)

FOREIGN PATENT DOCUMENTS

GB 2 315 246 A 1/1998

OTHER PUBLICATIONS

Exhibit A—Letter (HNG-14) from Creative Building Products Division of Spirit of America Corporation, 4307 Arden Drive, Fort Wayne, IN 46804 from U.S. Department of Transportation's Federal Highway Administration regarding Recycled Plastic Highway Spacer Block and composition of same, dated Mar. 26, 1996, pp. 1-4.

(Continued)

*Primary Examiner*—Michael P Ferguson
(74) *Attorney, Agent, or Firm*—Carrithers Law Office, PLLC; David W. Carrithers

(57) ABSTRACT

An improved guard rail system spacer block having a front face, a rear face and an outer circumferential undulating surface surrounding a plurality of individual spaced apart cavities that extend from one of such faces to the other. Lugs project from the rear face to support the block on a post of a roadway guard rail system and align it with the post during installation of the system and a lug projects from the front face to temporarily support a guard rail strip during installation of the guard rail system.

7 Claims, 15 Drawing Sheets

U.S. PATENT DOCUMENTS

| | | | | |
|---|---|---|---|---|
| 3,591,144 | A | 7/1971 | Iving | |
| 3,603,562 | A | 9/1971 | Glaesener | |
| 3,704,861 | A | 12/1972 | Glaesener | |
| 3,784,167 | A | 1/1974 | Glaesener | |
| 3,825,218 | A | 7/1974 | Krumbein et al. | |
| 3,825,229 | A | 7/1974 | Bartlett et al. | |
| 3,900,651 | A | 8/1975 | Hoppe et al. | |
| 3,963,218 | A | 6/1976 | Glaesener | |
| 3,982,735 | A | 9/1976 | Fornells | |
| 4,047,701 | A | 9/1977 | Glaesener | |
| 4,090,694 | A | 5/1978 | Vincent | |
| 4,138,093 | A | 2/1979 | Meinzer | |
| 4,298,075 | A | 11/1981 | Sweeney | |
| 4,312,600 | A | 1/1982 | Schaaf et al. | |
| 4,406,563 | A | 9/1983 | Urlberger | |
| 4,553,875 | A | 11/1985 | Casey | |
| 4,684,107 | A | 8/1987 | Robbins, Jr. | |
| 4,739,971 | A | 4/1988 | Ruane | |
| 4,986,694 | A | 1/1991 | Delamere | |
| 5,152,507 | A | 10/1992 | Lee | |
| 5,195,727 | A | 3/1993 | Liao et al. | |
| 5,203,543 | A | 4/1993 | Fleury | |
| 5,219,241 | A | 6/1993 | Picton | |
| 5,261,647 | A | 11/1993 | Venegas, Jr. et al. | |
| 5,277,516 | A | 1/1994 | Strieter | |
| 5,284,236 | A | 2/1994 | Ohta et al. | |
| 5,336,016 | A | 8/1994 | Baatz | |
| 5,402,987 | A | 4/1995 | Duyck et al. | |
| 5,429,449 | A | 7/1995 | Baatz | |
| 5,503,496 | A | 4/1996 | Voigt | |
| 5,507,473 | A | 4/1996 | Hammer et al. | |
| 5,791,811 | A | 8/1998 | Yoshino | |
| 6,007,269 | A | 12/1999 | Marinelli | |
| 6,010,275 | A | 1/2000 | Fitch | |
| 6,036,399 | A | 3/2000 | Schalk | |
| 6,168,346 | B1 | 1/2001 | Ernsberger | |
| 6,179,273 | B1 * | 1/2001 | Edmunds et al. | 256/13.1 |
| 6,530,560 | B2 | 3/2003 | King | |
| 6,533,495 | B1 * | 3/2003 | Williams et al. | 404/6 |
| 6,588,972 | B1 * | 7/2003 | Bergeson et al. | 404/6 |
| 6,758,627 | B2 | 7/2004 | King | |
| D501,934 | S * | 2/2005 | Mushett | D25/118 |
| 7,234,687 | B2 | 6/2007 | King | |
| 7,478,796 | B2 * | 1/2009 | Burkett | 256/13.1 |

OTHER PUBLICATIONS

Exhibit B—HWYCOM Highway Composites Product Brochure regarding Fiberglass Breakaway Sign Supports and Barricades from an Internet publication at http://www.hwycom.com/products.htm, dated Mar. 26, 2001, pp. 1-3.

Exhibit C—Bryson Products, Inc.'s Product Information Brochure, regarding Plastic Block Fabrication from an Internet publication at http://www.guardrails.com/company.html, dated Sep. 12, 2001.

Exhibit D—Bryson Products, Inc.'s Interdepartmental Memo regarding recycled/synthetic guardrail blockouts from Bryson to District Construction Engineers of Mississippi Department of Transportation, dated Mar. 18, 1999, p. 1.

Exhibit E—Bryson Products, Inc.'s letter regarding recycled/synthetic guardrail blockouts from Alabama Department of Transportation to Bryson Products, Inc., dated Aug. 1998, p. 1.

Exhibit F—Bryson Products, Inc.'s letter regarding recycled/synthetic guardrail blockouts from North Carolina Department of Transportation to Bryson Products, Inc., dated Nov. 18, 1998, p. 1.

Exhibit G—Bryson Products, Inc.'s Product Bulletin regarding a RE-BLOCK (Recycled Plastic Block) obtained from the internet at http://www.guardrails.com/catalog/reblock.html, dated Sep. 12, 2001, pp. 1-3.

Exhibit H—Mondo Polymer Technologies, Inc. letter from U.S. Department of Transportation's Federal Highway Administration regarding Polyethylene Polymer Offset Blocks, dated Mar. 11, 1997, pp. 1-5.

Exhibit I—Mondo Polymer Technologies, Inc. Product bulletin No. 1097 MPT 100 regarding Polyethylene Polymer Offset Blocks, date not available, pp. 1-4.

Exhibit J—Material Safety and Data Sheet from Polymer Process Technologies, Inc., whose address is 171 Kelly Avenue, Akron, OH 44306, for PPT-SYS [R] Product for Rubber Applications and PPT-SYS [P] for Plastic Applications, dated Jun. 28, 1999, pp. 1-5.

Exhibit K—Material Safety and data Sheet from Polymer Process Technologies, Inc., whose address is 171 Kelly Avenue, Akron, OH 44306, for PPT-RNU Product dated Jun. 24, 1999, pp. 1-7.

* cited by examiner

GUARD RAIL MOUNTING BLOCK AND GUARD RAIL SYSTEM INCORPORATING THE SAME

RELATED APPLICATIONS

This application claims priority from U.S. Provisional application Ser. No. 60/901,378 filed on Feb. 14, 2007 and is a continuation-in-part of U.S. application Ser. No. 11/980,971 filed on Oct. 31, 2007 now U.S. Pat. No. 7,559,535 which is a continuation of U.S. application Ser. No. 11/821,954 filed on Jun. 26, 2007 which is a continuation of U.S. Pat. No. 7,234,687 which issued on Jun. 26, 2007 from U.S. application Ser. No. 11/081,821 filed on Mar. 16, 2005 which is a continuation-in-part of U.S. patent application Ser. No. 10/885,398 filed on Jul. 6, 2004, now abandoned and claims priority from U.S. Provisional Application Ser. No. 60/901,378 filed on Feb. 14, 2007 and U.S. patent application Ser. No. 10/385,006 filed on Mar. 10, 2003; which claim priority from U.S. Pat. No. 6,530,560 which issued on Mar. 11, 2003 from U.S. patent application Ser. No. 10/079,280 filed on Feb. 19, 2002 and U.S. Pat. No. 6,758,627 which issued on Jul. 6, 2004 from U.S. application Ser. No. 10/001,903 filed on Nov. 15, 2001 which claims priority from U.S. Provisional Application Ser. No. 60/249,037 filed on Nov. 15, 2000 all of which are incorporated by reference herein in their entirety. Reference to documents made in the specification is intended to result in such patents or literature cited are expressly incorporated herein by reference, including any patents or other literature references cited within such documents as if fully set forth in this specification.

TECHNICAL FIELD OF THE INVENTION

The present invention relates generally to roadway guard rail systems and, more particularly to an improved spacer block for attaching the guardrail strip to support posts anchored in the ground and to a guard rail system incorporating the improved block.

BACKGROUND OF THE INVENTION

Guardrails are commonly seen along the shoulder of selected sections of roadways. The guardrails comprise a strip of material, typically twelve (12) gauge galvanized steel, anchored to posts spaced apart from one another. A guard rail mounting block is disposed between the guard rail and each post. The guard rail strip may be fabricated from other materials such as aluminum, steel, fiberglass, or even synthetic materials. Most segments of guardrail are approximately twelve (12) feet in length and about ninety (90) pounds in weight.

This application is closely related to the following: U.S. patent application Ser. No. 10/885,398 filed on Jul. 6, 2004; and U.S. patent application Ser. No. 10/385,006 filed on Mar. 10, 2003; which claim priority from U.S. Pat. No. 6,530,560 which issued on Mar. 11, 2003 from U.S. patent application Ser. No. 10/079,280 filed on Feb. 19, 2002 and U.S. Pat. No. 6,758,627 which issued on Jul. 6, 2004 from U.S. application Ser. No. 10/001,903 filed on Nov. 15, 2001 which claims priority from U.S. Provisional Application Ser. No. 60/249,037 filed on Nov. 15, 2000 the substance of all of which is incorporated herein by reference thereto.

The strip of material conventionally is undulating in cross section to absorb energy when impacted by a vehicle. Such energy absorption is desired in an effort to prevent the vehicle from leaving the roadway or at least to influence the direction of the vehicle prior to it leaving the roadway. The corrugated strip may be about nine (9) inches wide with two crowns simulating the letter "W".

The posts typically are a selected length of a wide flange I-beam and are driven into or otherwise suitably anchored in the ground. Preferably, the support posts do not break off at ground level. It is preferred to have the posts yield upon impact in an effort to assist the guardrail in dissipating the impact force received from a vehicle.

While the strips of guard rail could be fastened directly to the posts it is preferred to have a spacer block disposed between the guardrail and the support post and thereby spacing the guardrail from the support posts. The spacing helps keep the wheels of the automobile from coming into contact with the support posts and thereby perhaps guiding the vehicle and providing at least some response time for the driver to regain control of the vehicle.

Conventional spacer blocks are typically made of wood but they have many shortcomings such as deteriorating with time, they are excessively heavy, they can give installers splinters and the typically contract and expand with seasonal changes. In addition when made from treated wood the chemicals which may be toxic leach out into the environment. While there are some plastic spacer block substitutes on the market, they are generally deficient in that they are typically wood block designs formed from a plastics material.

In most installation instances, it requires two to three people to attach a twelve (12) foot section of guard railing to support posts when using conventional spacer blocks. Typically one person is needed to hold the guardrail while another person aligns and holds the spacer block in position. A third person is often required to insert bolts used to secure the railing to the posts.

SUMMARY OF THE INVENTION

The aforementioned spacer or positioning block referenced in Applicant's pending applications and/or granted patents is rectangular in design. FIGS. 13-28 show Applicant's prior embodiment comprising a rectangular embodiment of the present invention as described in Applicant's aforementioned pending applications and granted patents with web, support members, and alignment member features some of which are also incorporated in embodiments of the offset positioning block of the present invention as shown in FIGS. 1-12.

A preferred embodiment of the instant invention comprises an injection-molded offset block composed of about 68.5 percent recycled high density polyethylene (HDPE), about 30 percent ground recycled rubber, about 0.5 percent blowing agent, and about 1 percent color concentrates. The composition is essentially same as for a preferred embodiments of the rectangular positioning block illustrated in FIGS. 13-28; however, the compositions for the positioning block have been successful using 52 percent HDPE and 45 percent rubber with acceptable variations thereinbetween.

The offset block embodiment of the instant invention comprises an upper and lower cylinder connected by additional structure that includes locations for bolt placement. With respect to Applicant's prior rectangular positioning block the embodiment of the offset positioning block in the instant application has been modified to alter its shape, width, and material composition (weight) of the block to eliminate webbing and reduce the weight and cost of the block while maintaining the same overall dimension of height and depth while providing as good as or better performance than the prior rectangular block design.

More particularly, in accordance with the present invention there is provided an improved guardrail support, attachment and offset positioning block. The improved offset guard rail mounting block of the present invention has a front face, a rear face and an outer circumferential undulating surface surrounding a plurality of individual spaced apart cavities that extend from one of the faces to the other and including lugs projecting from the rear face to support the block on the post and align it with the post and a lug projecting from the front face to temporarily support the guard rail strip during installation.

A preferred embodiment of the offset positioning block consists essentially of a pair of cylindrical sections have respective cavities therethrough spaced apart form one another by an intermediate section formed of sidewalls comprising a pair of opposing upper portions defining rounded angles forming parabolic shaped interior cavities separated from one another by a sidewall defining a V-shaped lower portions connecting the opposing upper portions defining parabolic shaped interior cavities. Moreover, the sidewalls forming the V-shaped lower portions share a sidewall with spaced apart cylindrical center cavities which intersect legs of the sidewalls comprising the parabolic shaped interior cavities. Thus, the positioning block includes an upper and lower cylindrical section having cavities therethrough connected by a generally diamond shaped center section.

Further, the present invention provides an offset spacer block having a reduced amount of material without sacrificing impact strength.

A principal object of the present invention is to provide a plastic/rubber composite spacer block that meets all required specifications set forth by the Federal Highway Administration utilizing a minimum of materials without sacrificing strength.

The offset spacer block is environmentally friendly and capable of being manufactured using recycled plastic, tires, and/or combinations and sub-combinations thereof.

In keeping with the forgoing there is provided in accordance with one aspect of the present invention an offset spacer block for a roadway guard rail system. The block consists of a front face, a rear face and an outer circumferential undulating surface surrounding a plurality of individual spaced apart cavities that extend from one of the faces to the other. It includes lugs projecting from the rear face to support the block on a post of a roadway guard rail system and align it with the post during installation of the system. It also includes a lug projecting from the front face to temporarily support a guard rail strip during installation of the guard rail system.

In accordance with a further aspect of the present invention there is provided in a roadway guard rail system that includes a series of posts anchored in the ground and projecting upwardly therefrom in selected spaced apart relation, a guard rail comprising strips of suitable material secured to respective ones of the posts by suitable means an improved spacer block disposed between the guard rail and each of respective ones of the posts. The improved offset spacer block has a front face, a rear face and an outer circumferential undulating surface surrounding a plurality of individual spaced apart cavities that extend from one of the faces to the other. It includes a lug projecting from the rear face to support the block on a post of the roadway guard rail system and align it with the post during installation of the system. It also includes a lug projecting from the front face to temporarily support the guard rail strip during installation of the guard rail system.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein:

FIG. 2 is a perspective view on a larger scale of the upper portion of one of the posts and a rail section attached thereto and having a spacer block of the present invention disposed there between;

FIGS. 6 and 7 are perspective rear and front respective views of a modified spacer block wherein the cavities are closed at the front face of the spacer block by a plate having holes there through;

DETAILED DESCRIPTION OF PREFERRED EMBODIMENT

Figure 1:
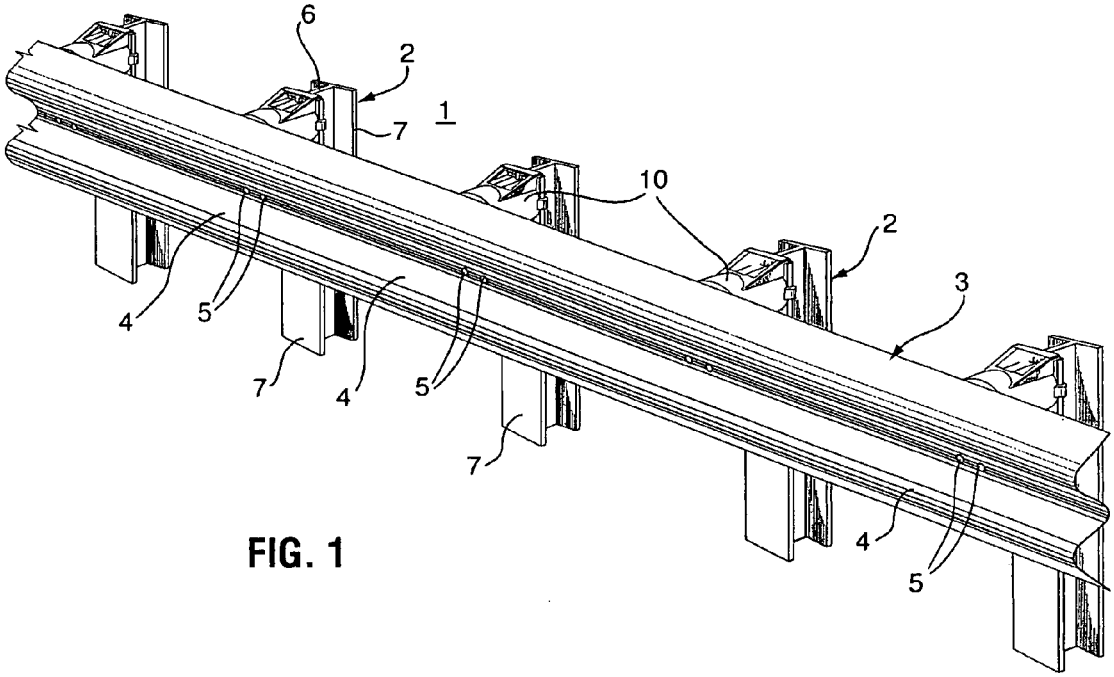
FIG. 1 is a perspective view of a portion of a roadside guard rail system that includes strips of railing attached to a series of spaced apart posts anchored in the ground and with a spacer block of the present invention interposed between the railing and each one of respective ones of the posts.
Figure 2:
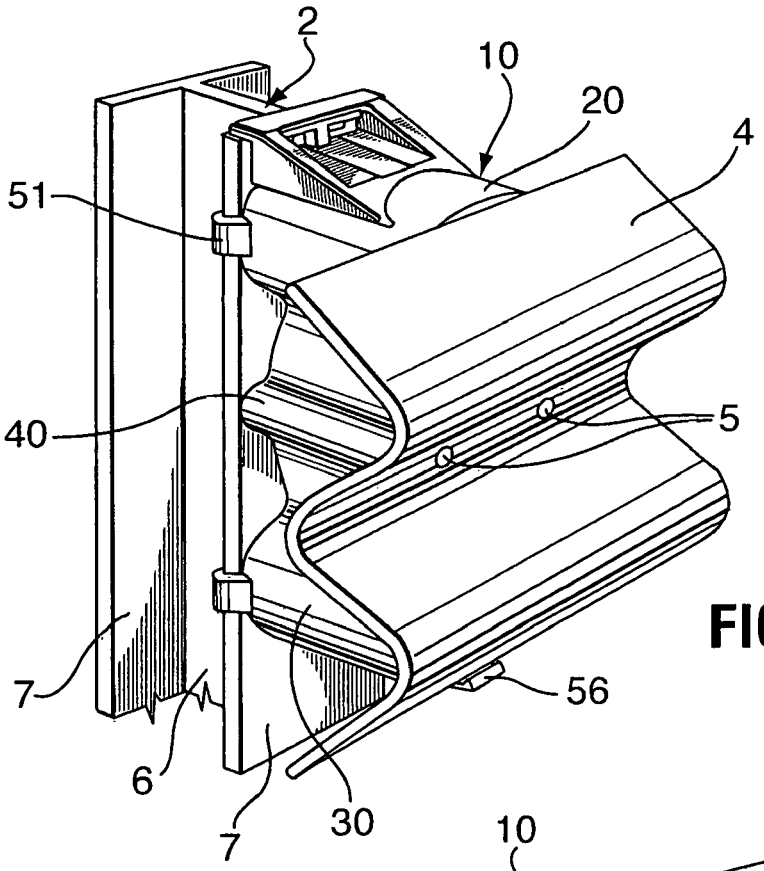
Figure 3:
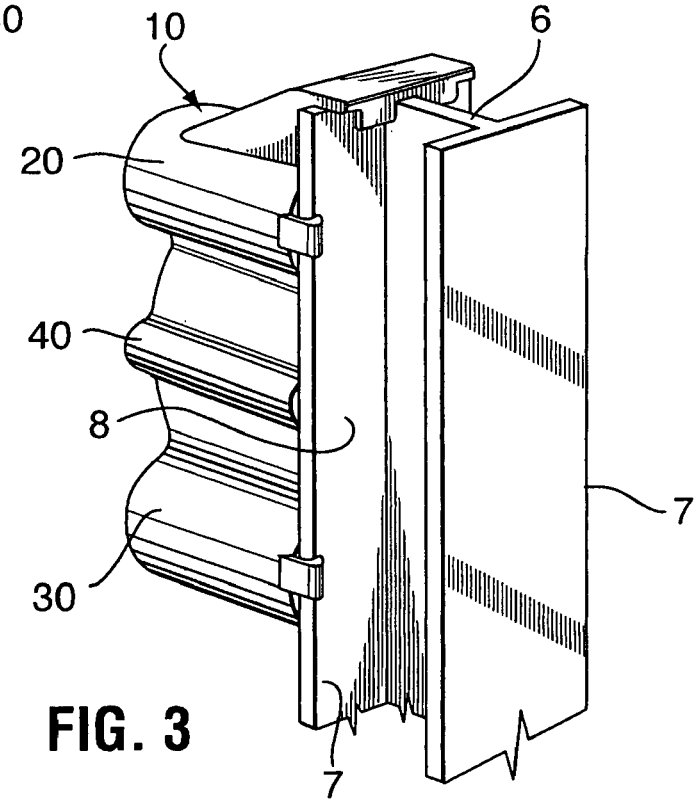
FIG. 3 is a perspective of the rear portion of the spacer block and post associated therewith.
Figure 4:
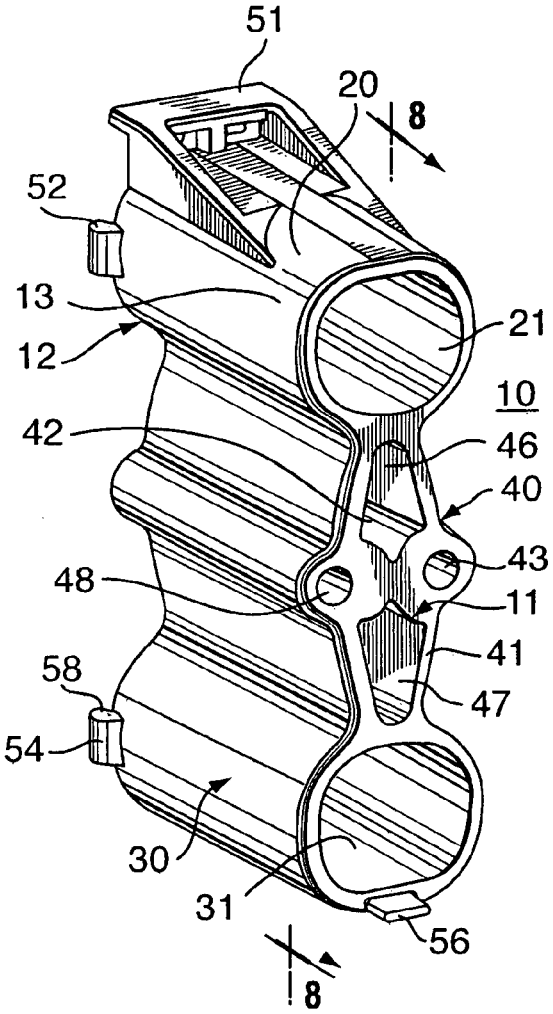
FIG. 4 is a front perspective view of the spacer block.
Figure 5:
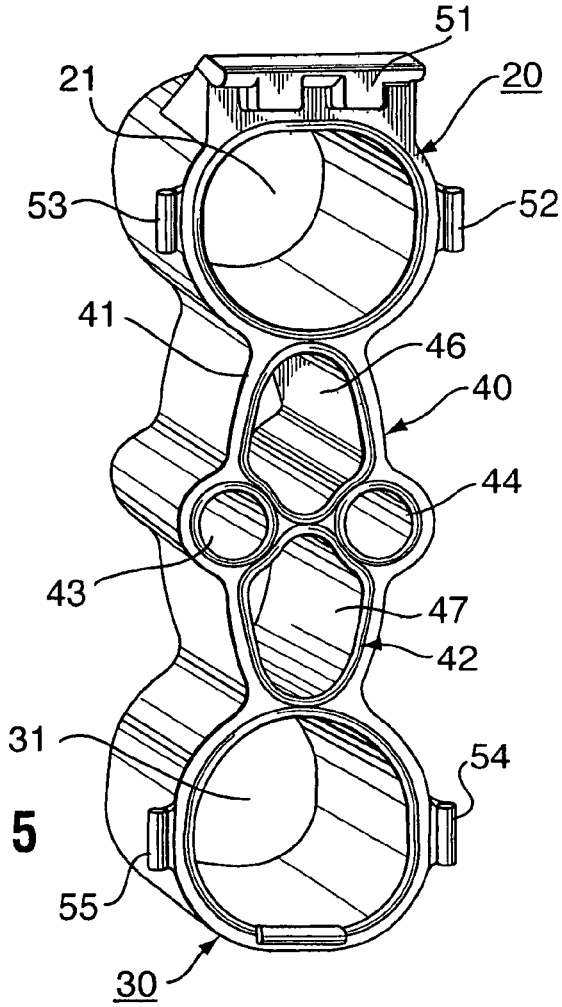
FIG. 5 is a rear perspective view of the spacer block.

In FIG. 1-12 there is illustrated a spacer block 10 for use with a portion of a roadway guard rail system 1 incorporating spacer blocks 10 provided in accordance with the present invention. The system 1 includes a series of posts 2 anchored in the ground and projecting upwardly therefrom in selected spaced apart relation and a guard rail 3 comprising strips 4 of suitable material secured to respective ones of the posts by a pair of bolt and nut units 5 with a spacer block 10 disposed between the guard rail and each of respective ones of the posts. The block has a pair of spaced apart through holes for the bolt and nut units 5. Each post is a length portion of a wide flange "I-Beam" having a web 6 interconnecting a pair of spaced apart flanges 7.

The improved guard rail mounting block 10 of the present invention has a front face 11 that abuts a rear face of the guard rail, a rear face 12 that abuts a side face of the post associated therewith and an outer undulating circumferential surface 13 surrounding a plurality of individual spaced apart cavities that extend from one of the front and rear faces to the other.

Located at opposite ends of the block are first and second spaced apart respective generally cylindrical sections 20, 30 which are interconnected by an intermediate block section 40. The intermediate section 40 has respective first and second spaced apart leg portions 41, 42 with respective cylindrical enlargements 43, 44. These enlargements are interconnected by a web 45 and have respective through holes 47, 48 for bolts of the bolt and nut units 5 used to secure the railing to a post.

The cylindrical sections 20, 30 have respective cavities 21, 31 and the intermediate section 40 has cavities 46, 47 separated from one another by the web 45. All of the cavities extend from one to the other of the front and rear faces 11, 12.

The block has lugs projecting therefrom that facilitate in-situ assembly of the guard rail system by one person. A first lug 51 projects from the rear face 12 of the block at a position at an upper end thereof and during assembly this lug rests on the upper end of one flange of the post anchored in and projecting upwardly from the ground. A first pair of lugs 52, 53 are located opposite one another proximate mid position of the cylindrical section 20 and similarly a second pair of lugs 54, 55 project from the cylindrical section 30. These lugs are preferably spaced so as to be disposed adjacent opposite edges of the flange of the "I-beam" post. The lugs may be so shaped (i.e. a groove 58—see FIG. 4) on the face thereon facing the edge of the web of the post and the pairs of lugs so located as to snap fit onto the web and there by temporarily retain the block on the post and thereby facilitating assembly. The lugs are also so positioned as to align the through holes 47, 48 with a spaced apart pair of holes 8 in the flange of the beam. A lug 56 projects from the front face 11 of block and it is disposed at the lower end of the cylindrical section 30. During assembly of the guardrail a bottom edge at the leading end of a length of the metal strip is placed on this lug. With the metal strip in place the installer uses two bolt and nut units to secure the trailing end of that strip and the leading end of a previously positioned strip on the post at that location.

The spacer block 10 is formed under heat and pressure, in a mold, from material comprising preferably a mixture of ground rubber and plastics material. The rubber may be virgin or reclaimed natural or synthetic and/or combinations or sub-combinations thereof.

The spacer blocks 10 preferably have a core 59 disposed intermediate the outer wall surfaces that is more porous than the skin at the outer wall surfaces (see FIG. 9) with the transition from skin to core being preferably gradual.

Figure 6:
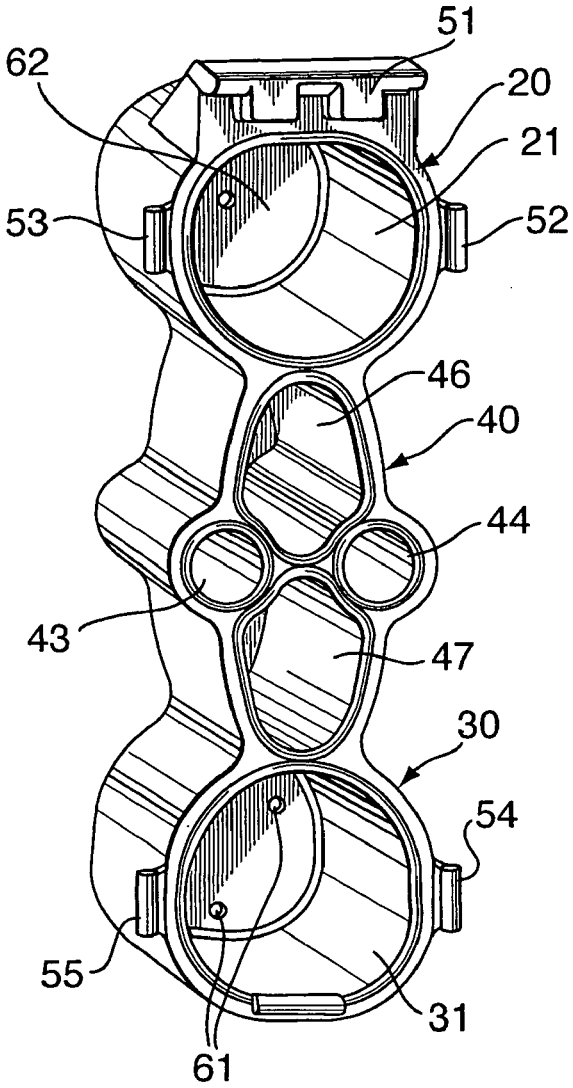
Figure 7:
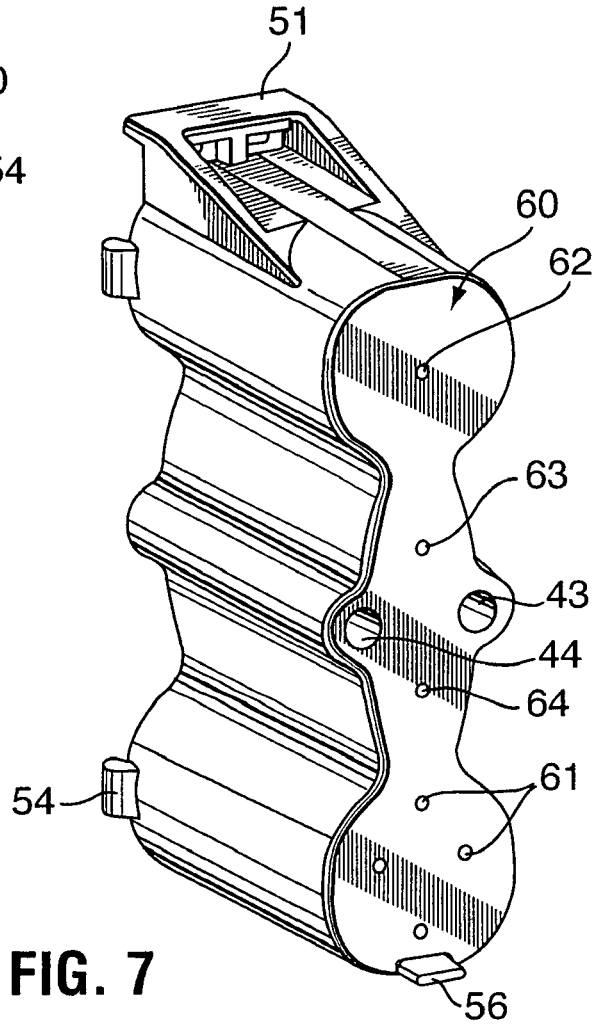
Figure 8:
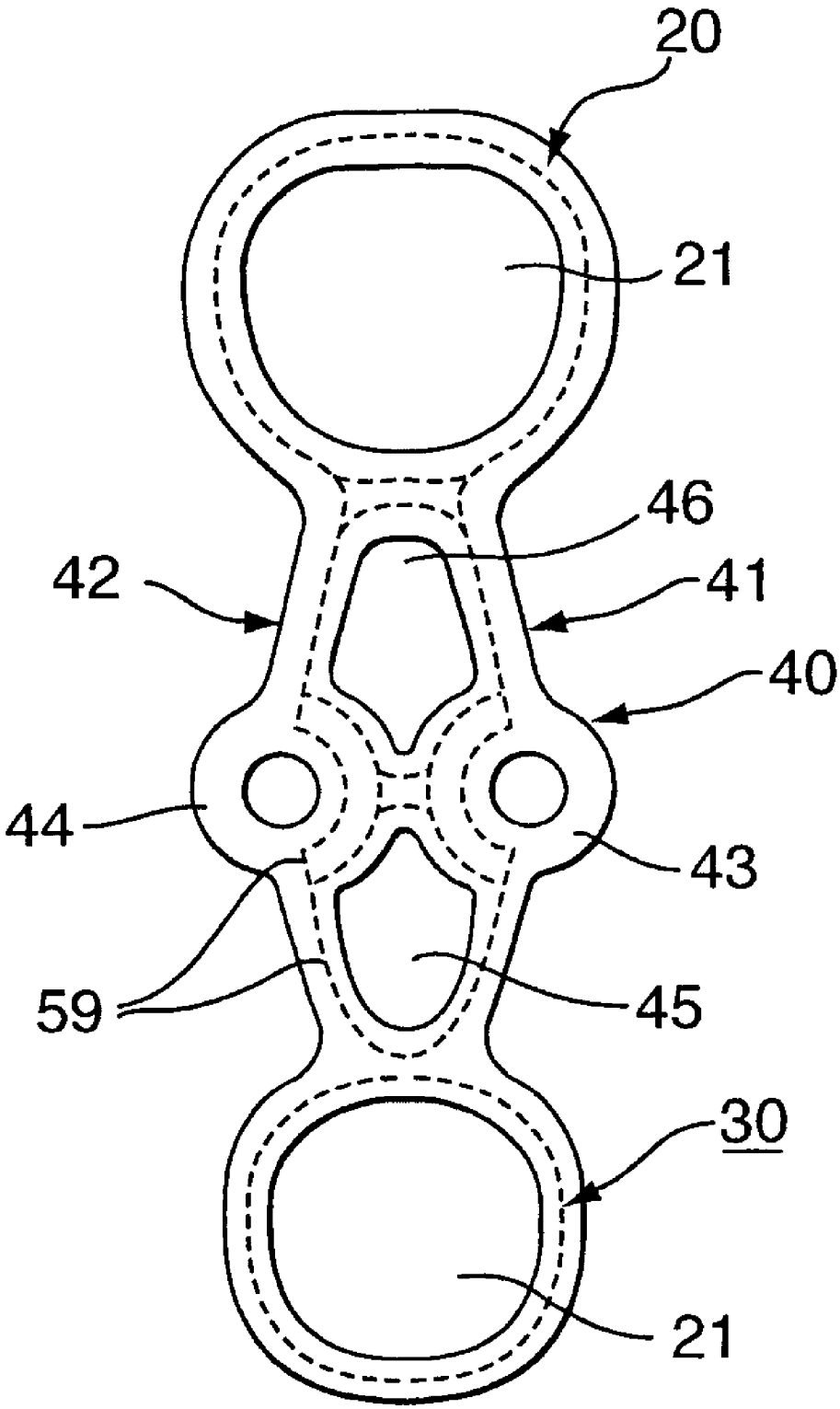
FIG. 8 is a sectional view taken along line 8-8 of FIG. 1.
Figure 9:
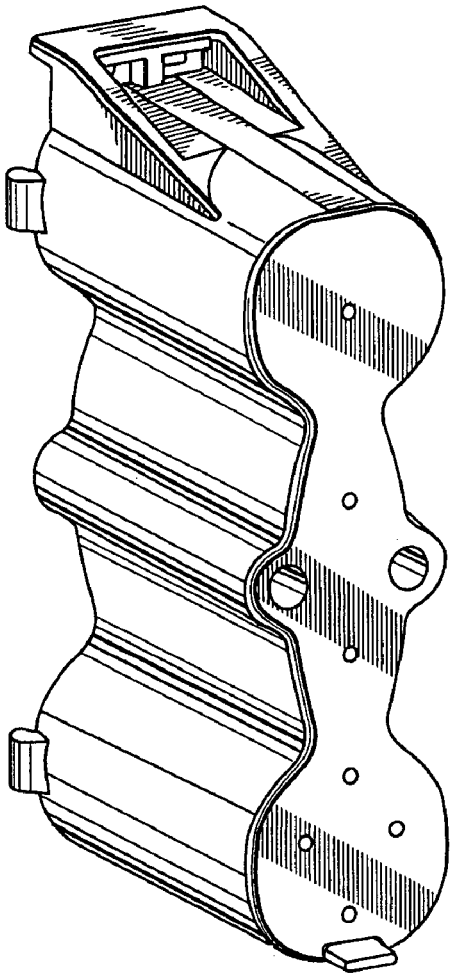
FIG. 9 is an enlarged perspective view of the embodiment of FIG. 7.
Figure 10:
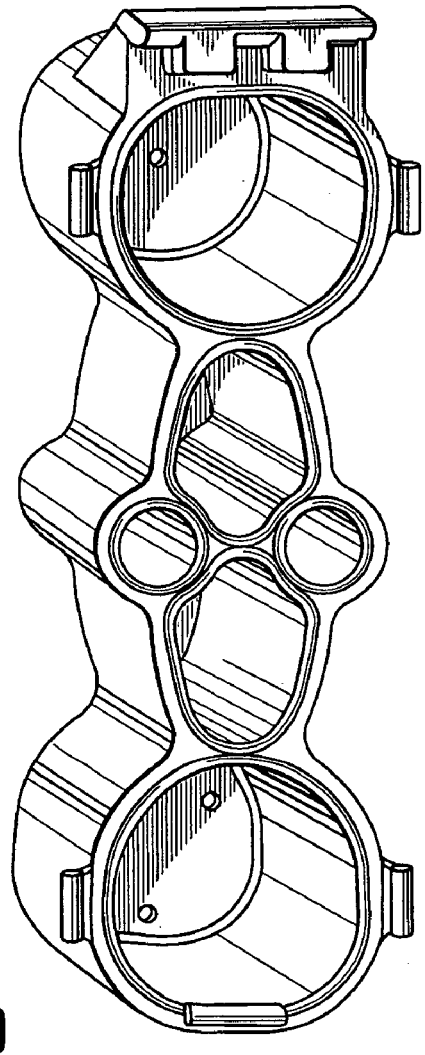
FIG. 10 is an enlarged perspective view of the embodiment of FIG. 6.
Figure 11:
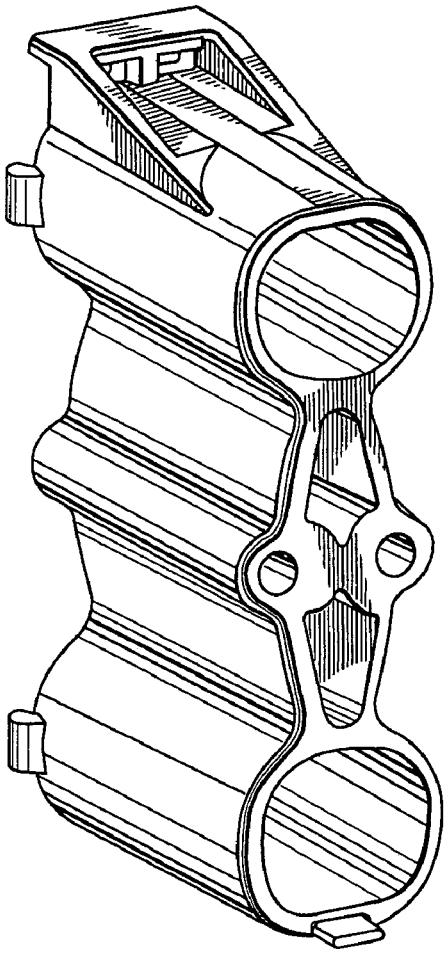
FIG. 11 is an enlarged perspective view of the embodiment of FIG. 4.
Figure 12:
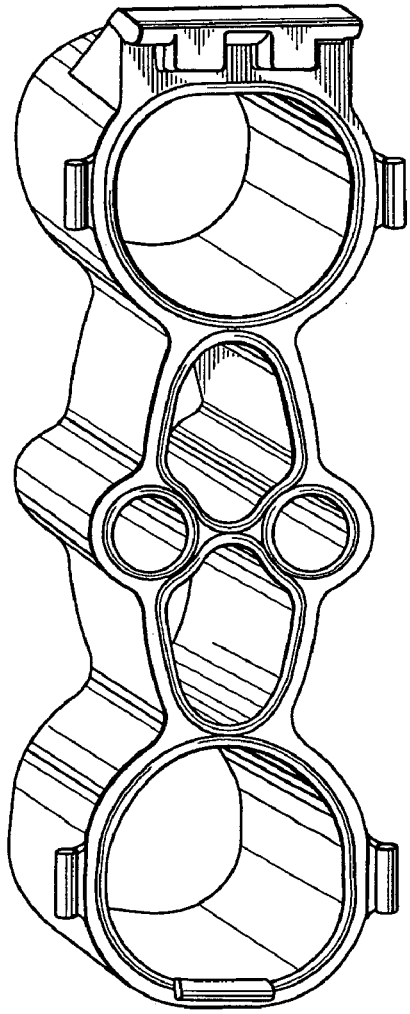
FIG. 12 is an enlarged perspective view of the embodiment of FIG. 5.
Figure 13:
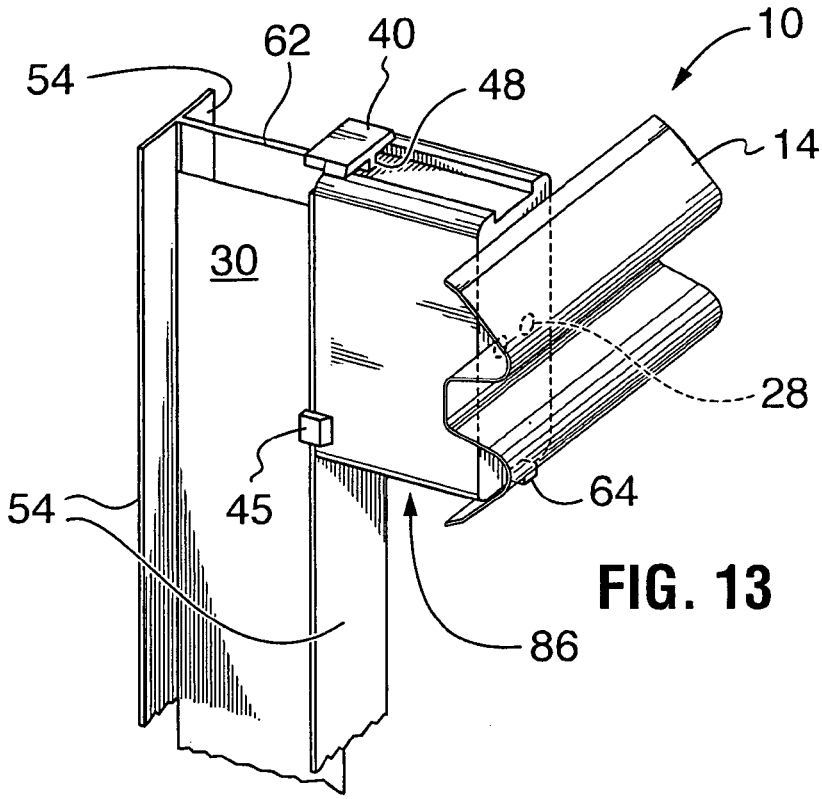
FIG. 13 is a perspective view showing a two crown guardrail roadway safety barrier system according to teachings of the present invention.
Figure 14:
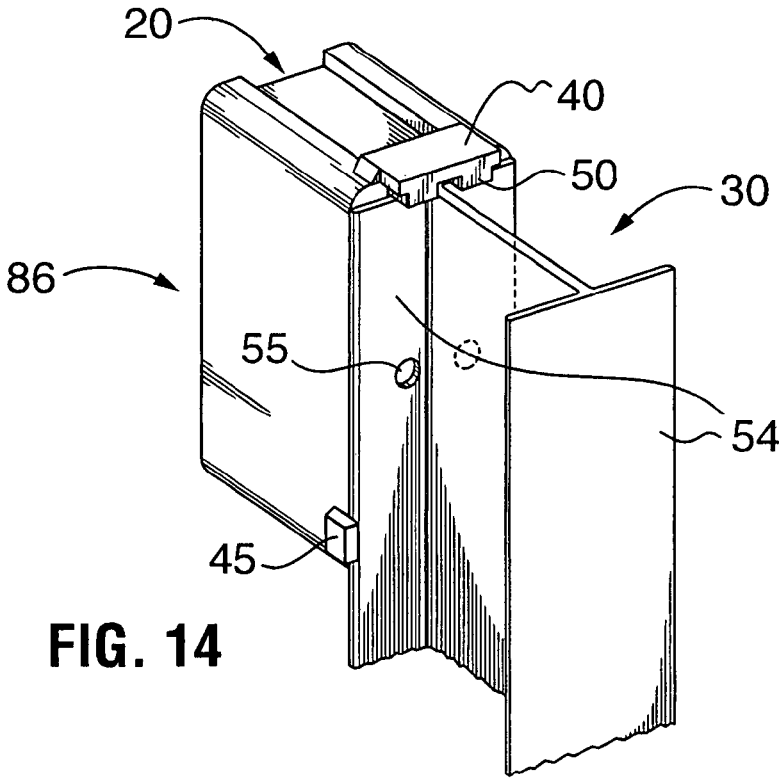
FIG. 14 is an expanded view showing the engagement or positioning mechanism of the spacer block illustrated in FIG. 2*a* according to teachings of the present invention.
Figure 15:
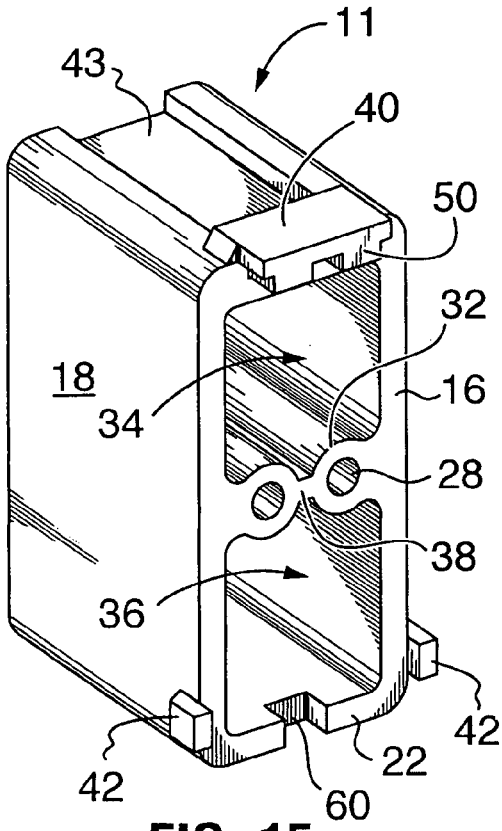
FIG. 15 is a perspective view showing a rear and side of one embodiment of a spacer block according to teachings of the present invention.
Figure 16:
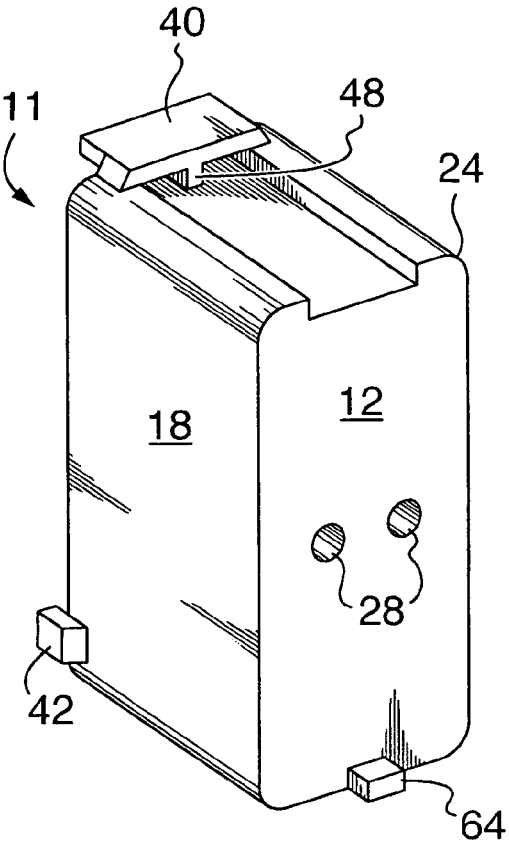
FIG. 16 is a perspective view of the spacer block depicted in FIG. 15 showing a front and side of the spacer block according to teachings of the present invention.
Figure 17:
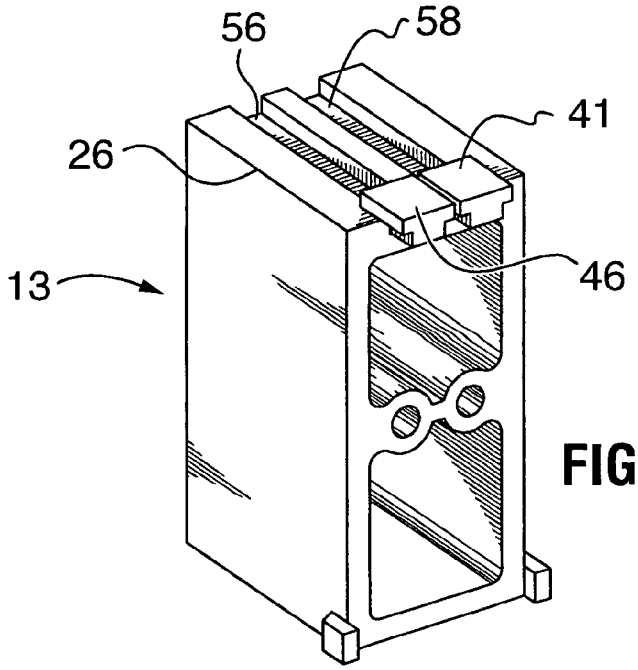
FIG. 17 is a perspective view showing an alternate embodiment of a spacer block according to teachings of the present invention.
Figure 18:
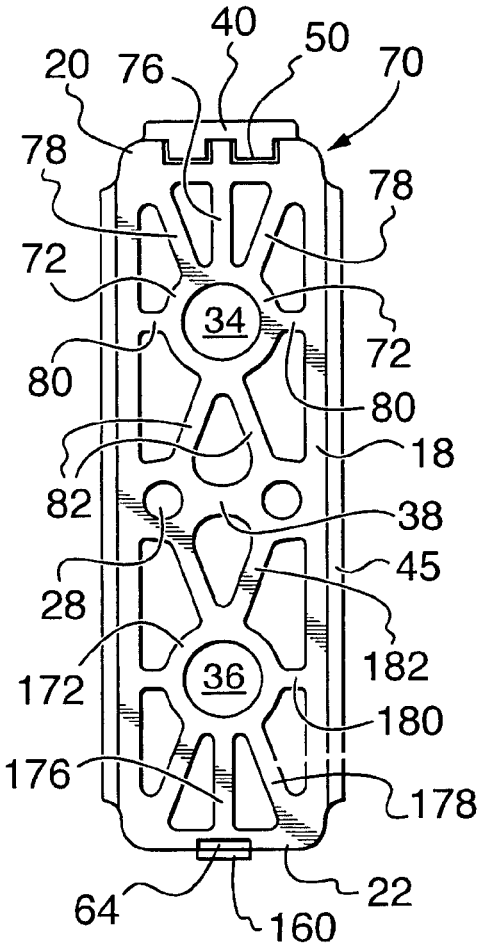
FIG. 18 is a plan view showing the front of one embodiment of a spacer block according to teachings of the present invention.
Figure 20:
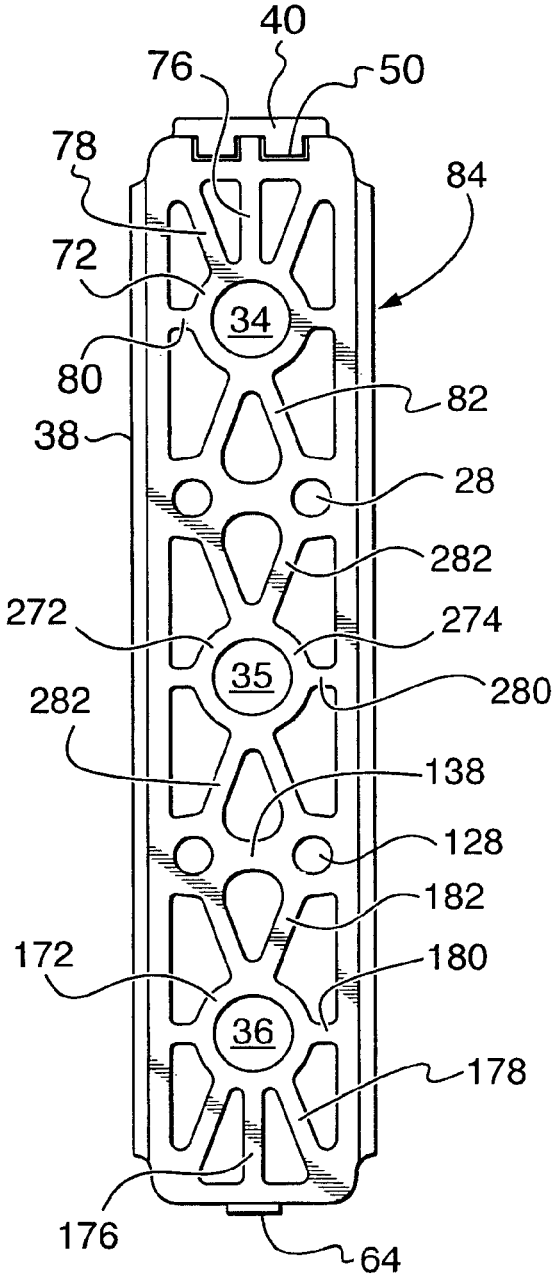
FIG. 20 is a plan view showing a front view of a spacer block for use with a thrie-beam guardrail and utilizing a webbed reinforcement arrangement.
Figure 19:
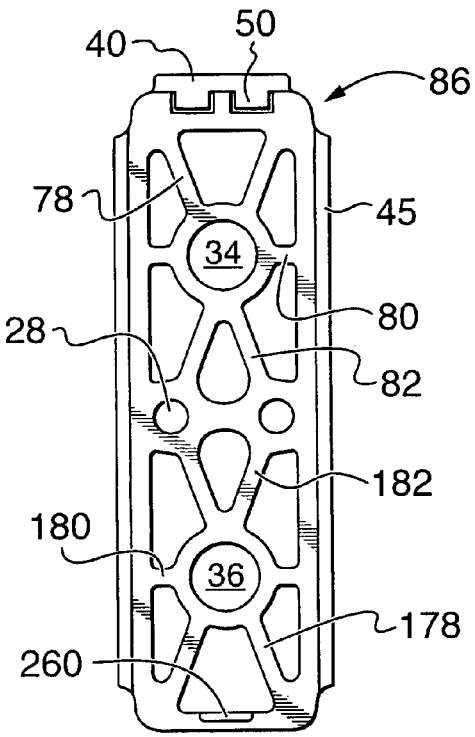
FIG. 19 is a plan view showing the back of the embodiment of FIG. 18 according to teachings of the present invention.
Figure 21:
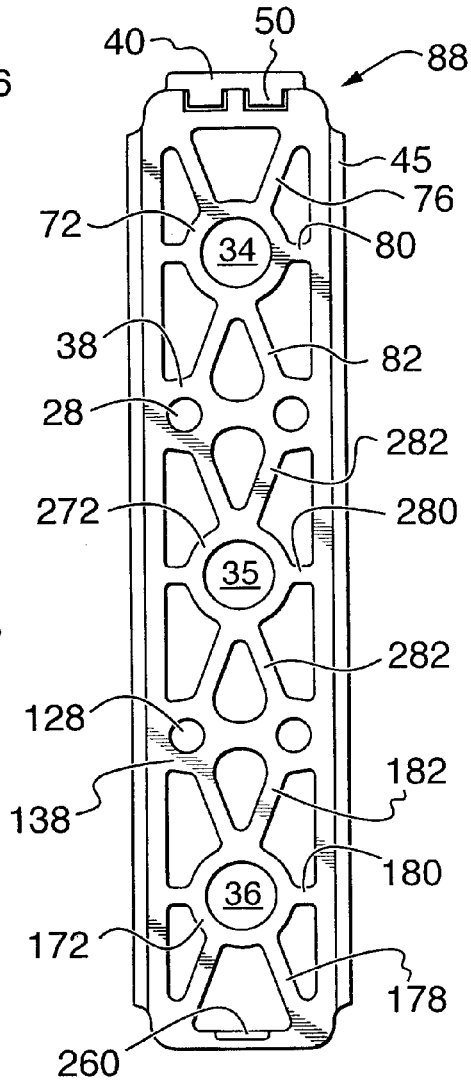
FIG. 21 is a plan view showing a rear view of the spacer block embodiment of FIG. 20 for use with a thrie-beam guardrail and utilizing a webbed reinforcement arrangement.
Figure 22:
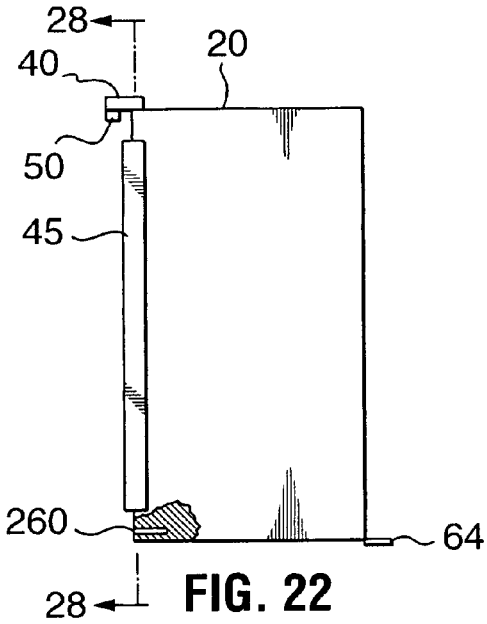
FIG. 22 is a side view of a spacer block formed from structural foam according to teachings of the present invention.
Figure 23:
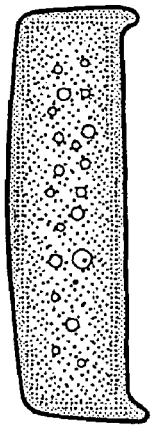
FIG. 23 is a top view, in section, showing a spacer block having a cellular core and an integrated solid skin on each side thereof according to teachings of the present invention.
Figure 24:
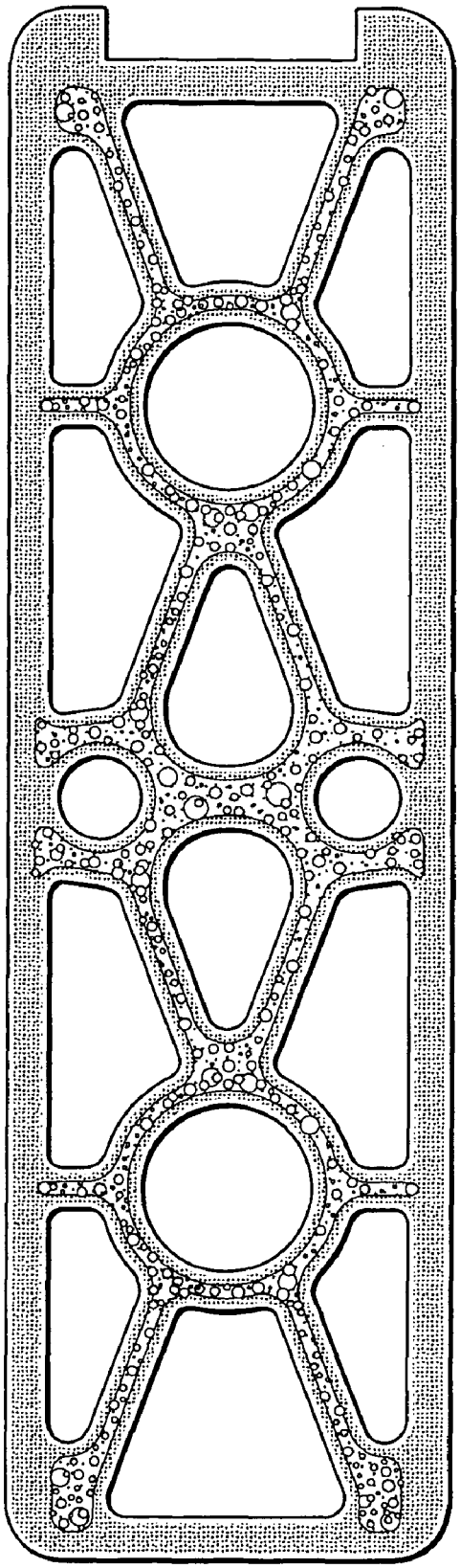
FIG. 24 is a plan view, in section, of the structural foam spacer block a cellular core and an integral solid skin, wherein the transition from skin to cellular core is gradual, according to the teachings of the present invention.
Figure 25:
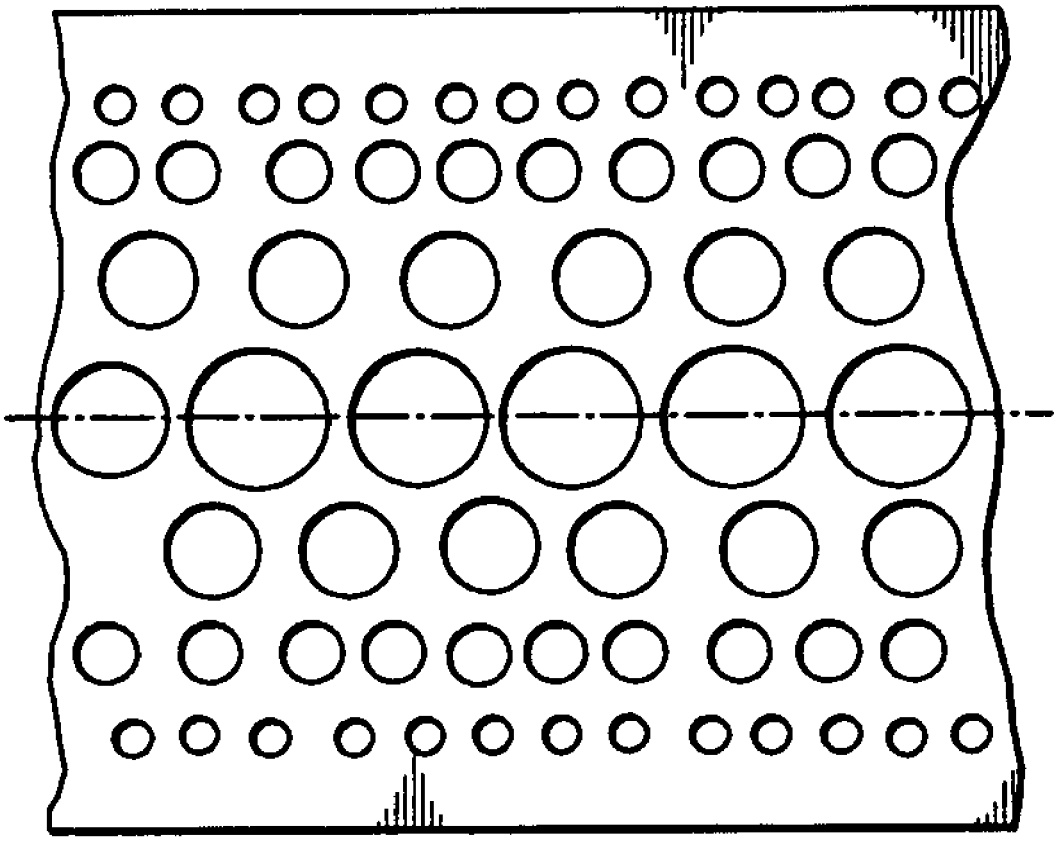
FIG. 25 is a drawing depicting the formation of bubbles in structural foam which shrink from the center toward the edge eventually forming a solid skin.
Figure 26:
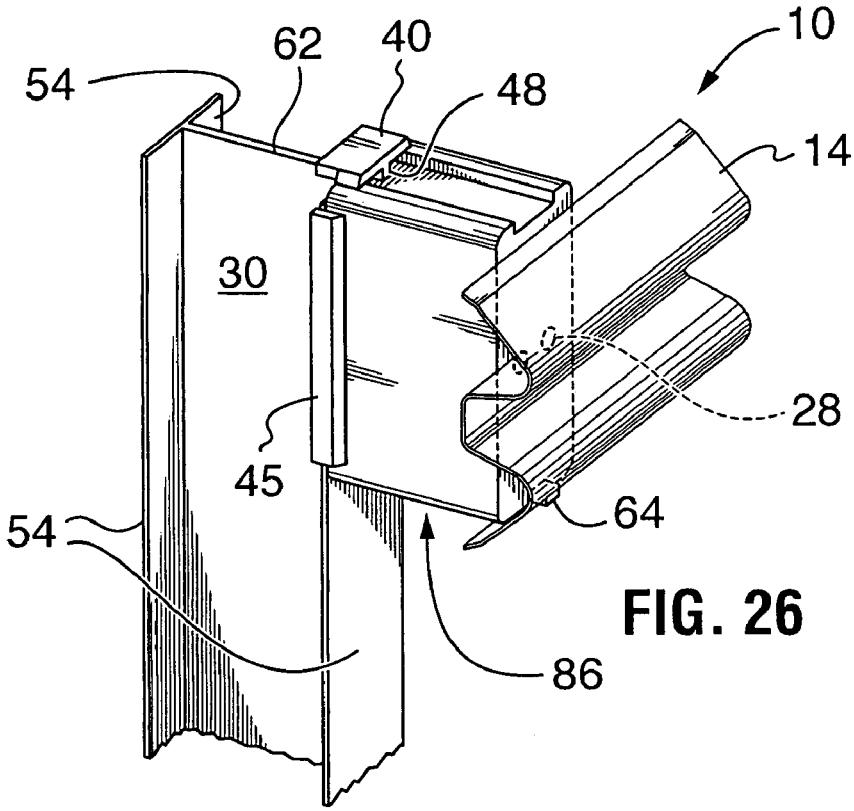
FIG. 26 is a perspective view showing a portion of a two-crown guardrail roadway safety barrier system incorporating a structural foam spacer block according to the teachings of the present invention.
Figure 27:
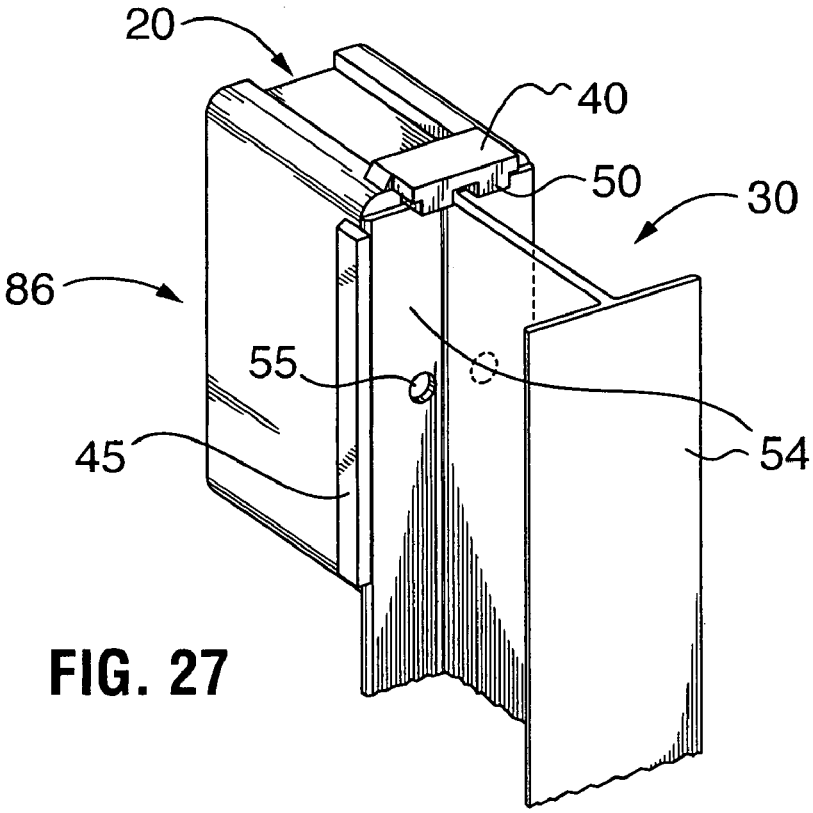
FIG. 27 is a perspective view of a guardrail support assembly incorporating a structural foam spacer block according to the teachings of the present invention.
Figure 28:
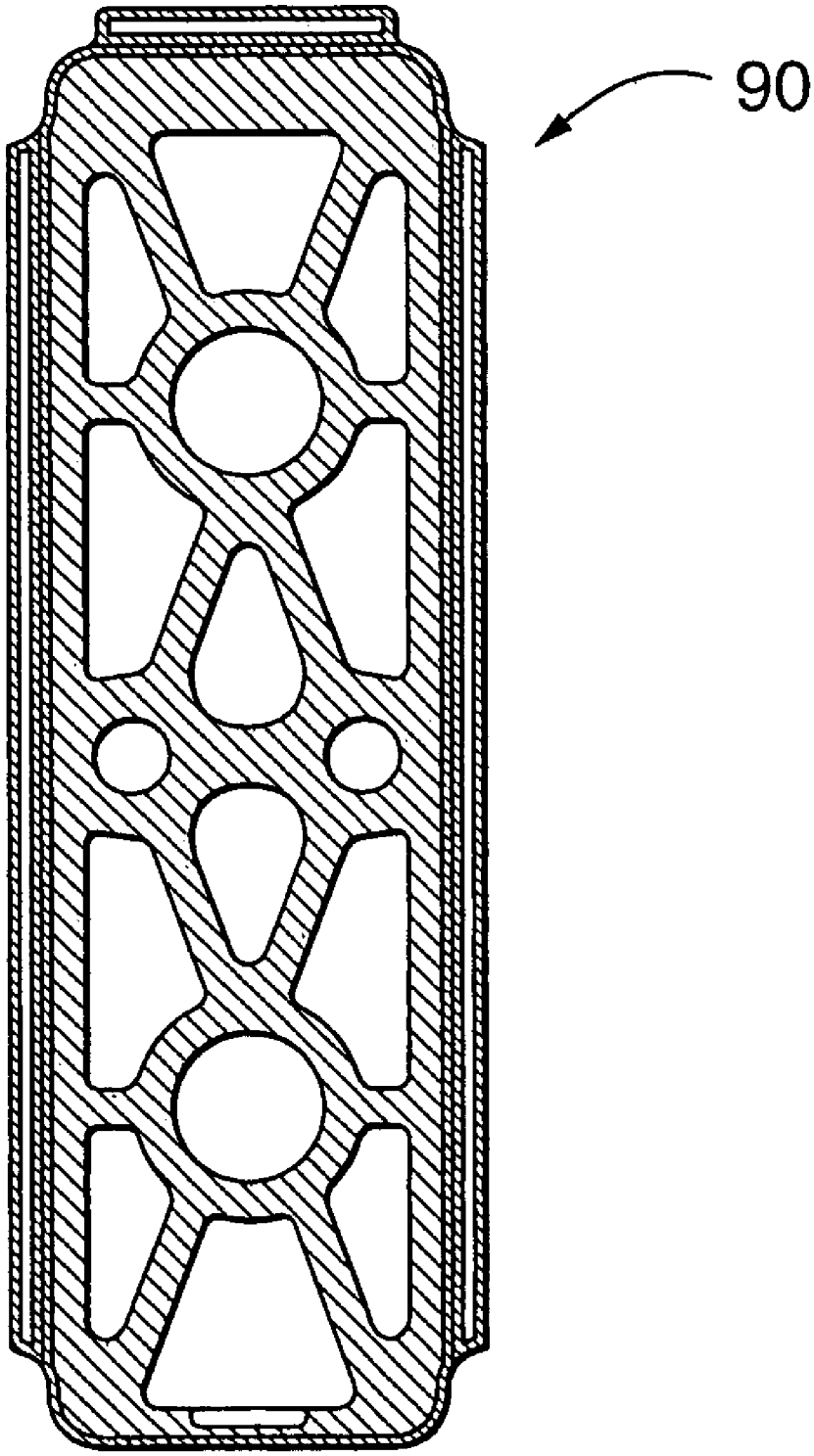
FIG. 28 is a spacer block formed having solid webbing.

A modification to the block 10 is illustrated in FIGS. 6 and 7 wherein a plate 60 overlies the front face 11 of the block. The plate 60 is shown as a separate element but obviously may be incorporated as an integral part of the block during manufacture of the same. The block face cover 60 has air passages hole 61 into the block cavity 31, air passage hole 62 into the cavity 21 and air passage holes 63, 64 into respective cavities 46, 47.

One material that may be used in the construction of spacer block 11 comprises one or more polymers (such as polyethylene, polypropylene, polyethylene terephthalate, nylon, polyurethane, polyvinyl chloride, and mixtures thereof), and a polymer and rubber blend. Other plastic materials which may be used include, but are not limited to, ABS, Acetyl, polypropylene oxide, nylon PBT, polycarbonate, polystyrene, modified polyphenylene oxide, polyester, fiberglass filled nylon, fiberglass filled styrene, fiberglass filled SAN, acrylic, ethylene copolymers, ionomers, and polysulfone. Spacer block 11 may also be formed from a single polymer or mixtures of various polymers. The polymers used may be virgin material or polymers including regrind materials, such as reground polyethylene, ethylene. The rubber and/or elastomeric compound that may be incorporated may also include a natural rubber or synthetic rubber, either virgin, regrind material or combinations thereof. It is contemplated that fiberglass may also be used as an additive or substitute raw material for all or at least a portion of the plastic material. Fillers such as wood chips, sawdust, calcium carbonate may also be used. The rubber from used tires that has long been a problem for the environment may also be used as a source of rubber for the present invention. In a variety of embodiments, the spacer blocks themselves may be recyclable.

A preferred embodiment of spacer block 10 may be formed with a low-pressure injection molding machine using thermoplastics and/or rubber. A screw may be used to plasticate a mixture of polymer and up to one (1) percent chemical blowing agent, preferably up to one-half (½) percent, wherein the screw barrels have zones maintained at different temperatures and are arranged so that the blowing agent is maintained near the nozzle. A foamable mixture may thereby be produced, pumped under pressure to an accumulator and stored in a molten state at a pressure higher than the foaming pressure. Upon opening a valve in the nozzle, a portion of the foamable mixture may be discharged from the accumulator into the mold. The mold cavity is then filled by the gases generated by the decomposition of the chemical blowing agent, forcing the material into the shape of the mold. The pressure and temperature of the material in the mold then drop, resulting in bubbles developing in the core. In a preferred embodiment, the melt is charged at about four hundred (400) degrees Fahrenheit and the melt temperature is between about three hundred and eighty (380) degrees Fahrenheit to four hundred and fifty (450) degrees Fahrenheit. It should be noted that structural foam spacer blocks 11 made in accordance with teachings of the present invention may be made from a rubber compound in combination with a plastic. Preferably, the plastic will encapsulate the rubber particles and act as a binder. The rubber preferably produces enough gas during processing under the heat and pressure of the low-pressure injection molding process that the structural foam product can be made without the addition of any type of chemical blowing agent.

Spacer block 10 of the present invention may be formed by injection molding, preferably low-pressure injection molding, such as is used for structural foam products. Spacer block 10 may include virgin or regrind plastic or combinations thereof without any rubber. The plastic may be selected from such polymers as polyethylene, polypropylene, polyethylene terephthalate, nylon, polyurethane, polyvinyl chloride, ABS, Acetyl, polypropylene oxide, nylon, PBT, polycarbonate, polystyrene, modified polyphenylene oxide, polyester, fiberglass filled nylon, fiberglass filled styrene, fiberglass filled SAN, acrylic, ethylene copolymers, ionomers, and polysulfone. The spacer block 10 of the present invention may be formed from a single type of polymer or mixtures of various polymers. Typically a chemical blowing agent in an amount less than five (5) percent, and preferably in an amount less than one (1) percent and preferably in an amount less than one-half (½) percent may be used with one hundred (100) percent polymer composition spacer blocks 10.

A rubber and/or elastomeric compound may be incorporated in the formulation as a substitution for up to seventy (70) percent, and more preferably less than fifty (50) percent and most preferably from about forty (40) to fifty (50) percent depending upon the strength to weight ratio desired and the structural properties required for a particular application or size of guardrail. Regrind rubber is typically less expensive than plastic materials. Therefore, as much as forty (40) to fifty (50) percent regrind rubber may be used in a spacer block designed for normal impact applications or support posts 30 spaced close together. A composition with less than forty-five (45) percent rubber may be desirable for applications requiring support posts 30 to be spread further apart from one another. The type of rubber may also be an important consideration in that the rubber may be comprised of a natural rubber or synthetic rubber, either virgin material, re-grind material or combinations thereof. Additives such as fillers and fiberglass may further reduce the cost of manufacture and provide the requisite strength. Because of the gases produced during injection molding of the rubber particles, the use of a chemical blowing agent is an option and is not required when processing the plastic and rubber mixed compositions.

One material that may be used in the construction of spacer block 10 comprises one or more polymers (such as polyethylene, polypropylene, polyethylene terephthalate, nylon, polyurethane, polyvinyl chloride, and mixtures thereof), and a polymer and rubber blend. Other plastic materials which may be used include, but are not limited to, ABS, Acetyl, polypropylene oxide, nylon PBT, polycarbonate, polystyrene, modified polyphenylene oxide, polyester, fiberglass filled nylon, fiberglass filled styrene, fiberglass filled SAN, acrylic, ethylene copolymers, ionomers, and polysulfone. Spacer block 10 may also be formed from a single polymer or mixtures of various polymers. The polymers used may be virgin material or polymers including regrind materials, such as reground polyethylene, ethylene. The rubber and/or elastomeric compound that may be incorporated may also include a natural rubber or synthetic rubber, either virgin, regrind material or combinations thereof. It is contemplated that fiberglass may also be used as an additive or substitute raw material for all or at least a portion of the plastic material. Fillers such as wood chips, sawdust, calcium carbonate may also be used. The rubber from used tires that has long been a problem for the environment may also be used as a source of rubber for the present invention. In a variety of embodiments, the spacer blocks themselves may be recyclable.

Another embodiment of the present invention comprises polyethylene together with regrind rubber ranging in an amount of up to forty-five (45) percent. Yet another more preferred embodiment utilizes from about thirty (30) to forty-five (45) percent regrind rubber and utilizes ethylene as the binding polymer.

Yet another embodiment utilizes a powdered processing aid from Polymer Process Technologies, Inc. in Akron, Ohio referred to by the trademark PPT-SYS, (PPT-SYS® for rubber applications and PPT-SYS(P) for plastic applications), having a specific gravity of about one and one-one hundredth (1.01), a pH of about seven (7), and a melting point range of over six hundred (600) degrees Fahrenheit. Each of these powdered processing aids is a highly effective alloying agent for compatibilizing and alloying cured rubber, virgin or regrind, to form compounds having little or no change in physical properties.

Still another embodiment of spacer block 10 includes a blend of at least one polymer having among its ingredients one or more of the plastic materials set forth herein mixed and molded together with at least one rubber or elastomeric material. The ability to mold large blocks of plastic containing virgin and/or regrind thermoplastics obtained from such sources as reusable containers, alone or together with virgin or grind rubber from used tires or other sources, provides a useful means for the disposal and recycling of waste products. One embodiment utilizes grind rubber in combination with one or more thermoplastics extruded or molded by low-pressure injection molding or vacuum forming. The molding process is believed to encapsulate the rubber particles with the thermoplastic melt thereby providing a stronger blended product with enhanced performance capabilities as compared to a simple mixture of thermoplastic and rubber particles compressed together under high pressure. One source of the grind rubber is used vehicle tires, as indicated above, representing a new method of disposal for used tires.

Another embodiment may contain a non-toxic blend of naturally occurring materials, (plant polymers, gums, and anionic salts), marketed by Polymer process Technologies, Inc., under the trademark of PPT-RNU. When added to post consumer plastics of all kinds, PPT-RNU will typically repair heat history plastics to near virgin polymer condition in addition to or instead of the PPT-SYS (R)/(P). This material has a pH of about six and eight-tenths (6.8), a specific gravity of about one and five-hundredths (1.05), a melting point flow of over six hundred and fifty (650) degrees Fahrenheit, and it's generally used in amounts of up to ten (10) percent by weight, and more preferably, from about three (3) percent to about six (6) percent by weight.

Another embodiment utilizes both the PPT-RNU and PPT-SYS additives with rubber and a polymer, such as polyethylene, to enhance the compatibility and performance of regrind rubber from tires being compounded with virgin or recycled polymers such as polyethylene in conventional compounding equipment at processing temperatures of from about three hundred and sixty (360) degrees Fahrenheit to four hundred and ten (410) degrees Fahrenheit which is typical for extrusion and compounding operations.

Testing:

Pendulum testing was conducted by the Southwest Research Institute in accordance with the guidelines and provisions set forth by the National Cooperative Highway research Program Report 350 "Recommended Procedures for the Safety Performance Evaluation of Highway Features".

A single W6×8.5 steel galvanized guardrail post was embedded 44 inches in the soil. The offset positioning block was bolted along with a 12 inch long section of 12 gauge W-beam to the post with a 10 inch long×⅝ inch button head bolt. The 820 Kg mass pendulum, fitted with a flat steel face, impacted the test article at a speed of 35 KM/hr (22 mph) at a height of 18 inches about the grade.

During the test the positioning block detached from the post due to bolt failure after the post had bent rearward 20 inches and rotated in the soil more than 60 degrees. The rail lip at the bottom was knocked off during impact, however, the rail lip is considered an installation aid and not of structural significance. The bolt attachment hole showed slight elongation but no indication of the bolt tearing through the cast-in-place hole was noted. The block received minor damage from both top and bottom edges of the W-beam but did not suffer any structural damage.

Findings:

Based on the results of the pendulum test run, the offset spacer block was considered acceptable for use on the NHS when it conforms to the dimension noted above and is composed of the same materials as the tested block comprising 68.5 percent recycled high density polyethylene (HDPE), 30 percent ground recycled rubber, 0.5 percent blowing agent, and 1 percent color concentrates under the range of conditions tested.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplifications presented herein above. Rather, what is intended to be covered is within the spirit and scope of the appended claims.

I claim:

1. A guard rail spacer block for attaching a guard rail to a post, said spacer block comprising:

a front face for cooperatively engaging said post;

a rear face for cooperatively engaging said guard rail;

upper and lower cylindrical sections disposed at spaced apart upper and lower ends of said spacer block, respectively, and interconnected by a pair of spaced apart leg portions, a cavity being defined within each said cylindrical section, said cylindrical sections and said leg portions each extending from one to the other of said front and rear faces and defining an undulating outer circumferential surface of said spacer block;

a cylindrical enlargement disposed in each said leg portion, said cylindrical enlargements extending from one to the other of said front and rear faces with each cylindrical enlargement providing a through hole for a bolt to fasten said guard rail to said post;

an engagement mechanism comprising a lug coupled to an upper end of said upper cylindrical section, said lug extending from said rear face of said spacer block for engaging said post and said lug including at least two spaced part fingers coupled proximate a distal end of said lug, the fingers extending from a bottom surface of said lug and forming a gap between said fingers and said rear face of said spacer block, the gap between said fingers operable to engage respective sides of a web of an I-beam support post and the gap between said fingers and said rear face of said spacer block operable to engage respective sides of a flange of the I-beam support post;

an alignment mechanism comprising at least one pair of lugs coupled to and extending from said rear face of at least one of said upper and lower cylindrical sections, respectively, and disposed at opposing diametric positions of said at least one cylindrical section for maintaining lateral alignment of said spacer block on said post; and wherein said spacer block is composed of a polymeric material.

2. The guard rail spacer block as defined wherein a web interconnects said leg portions intermediate the length of said leg portions thereof.

3. The guard rail spacer block as defined in claim 2 including a pair of cavities disposed between said leg portions, said pair of cavities extending from one to the other of said front and rear faces and wherein said pair of cavities between said leg portions are separated from the other by said web.

4. The guard rail spacer block as defined in claim 3 including a plate covering said front face having a plurality of holes therethrough providing air passageways for respective ones of said cavities defined within said cylindrical sections and between said leg portions.

5. The guard rail spacer block as defined in claim 4 wherein said plate is an integral part of the block.

6. The guard rail spacer block as defined in claim 1 wherein said block is formed from a mixture of a plastics material and particles of rubber.

7. The guard rail spacer block as defined in claim 1 having walls of predetermined thickness and wherein said walls have a central core portion that is more porous than the remainder of the wall.

* * * * *